US012758842B2

(12) United States Patent
Betts

(10) Patent No.: US 12,758,842 B2
(45) Date of Patent: Oct. 13, 2026

(54) GOLF PUTTING APPARATUS

(71) Applicant: Jack Michael Betts, Eden Prairie, MN (US)

(72) Inventor: Jack Michael Betts, Eden Prairie, MN (US)

( * ) Notice: Subject to any disclaimer, the term of this patent is extended or adjusted under 35 U.S.C. 154(b) by 213 days.

(21) Appl. No.: 18/787,294

(22) Filed: Jul. 29, 2024

(65) Prior Publication Data

US 2025/0058196 A1 Feb. 20, 2025

Related U.S. Application Data

(60) Provisional application No. 63/520,105, filed on Aug. 17, 2023.

(51) Int. Cl.
*A63B 69/36* (2006.01)

(52) U.S. Cl.
CPC ..... *A63B 69/3676* (2013.01); *A63B 2210/50* (2013.01)

(58) Field of Classification Search
CPC ... A63B 69/3676; A63B 2210/50; A63F 9/12; A63F 9/1204; A63F 9/1208; A63F 2009/1228; A63F 2009/1232; F16B 5/0032; F16B 5/0052; F16B 5/0614; F16B 5/0012; A63H 33/06; A63H 33/065
See application file for complete search history.

(56) References Cited

U.S. PATENT DOCUMENTS

| | | | | |
|---|---|---|---|---|
| 4,099,887 | A * | 7/1978 | Mackenroth | A63H 33/065 40/739 |
| 5,087,046 | A * | 2/1992 | Mauch | A63B 67/02 206/315.9 |
| 5,310,187 | A | 5/1994 | Yamaguchi et al. | |
| 5,954,590 | A * | 9/1999 | Nixey | A63B 67/02 473/185 |
| 8,556,743 | B2 | 10/2013 | Forest | |
| 2004/0166292 | A1* | 8/2004 | Lee | A63F 9/1208 428/192 |
| 2009/0131187 | A1 | 5/2009 | Foster | |
| 2016/0339321 | A1 | 11/2016 | Barnes | |
| 2023/0121560 | A1* | 4/2023 | Jiang | F16B 5/0036 403/345 |

FOREIGN PATENT DOCUMENTS

| | | | | |
|---|---|---|---|---|
| DE | 4333089 | A1 * | 2/1994 | F16B 5/0052 |
| GB | 2219214 | A * | 12/1989 | A63C 5/031 |

* cited by examiner

*Primary Examiner* — Justin M Krause
(74) *Attorney, Agent, or Firm* — Fredrikson & Byron, P.A.

(57) ABSTRACT

A golf putting practice apparatus is provided that includes interlockable panels having openings that receive a golf ball. The interlockable panels are configured to interlock to form a triangular enclosure or square enclosure. A triangular enclosure includes three openings opposite to three corners. A square enclosure includes four openings, wherein each opening is opposite to another opening.

19 Claims, 7 Drawing Sheets

GOLF PUTTING APPARATUS

RELATED APPLICATION

The present application claims priority to U.S. provisional patent application No. 63/520,105, filed Aug. 17, 2023, the entire contents of which are incorporated herein by reference.

FIELD

The invention relates to a golf putting apparatus.

BACKGROUND

Golfers often desire to practice putting, but it can be cumbersome to do so. For example, some golfers travel to a golf course or other destination that includes an actual putting green. However, this can be a time-consuming process that is not accessible to everyone. Others use a putting apparatus they store at home or in an office. However, putting apparatuses are often difficult to set up and/or to put away because they require cumbersome assembly and disassembly. Also, others may avoid using a putting apparatus altogether because they do not have room to store it, or it may be too heavy to lift and move. These drawbacks are particularly bothersome to elderly golfers, who may not have room in their living quarters to store an apparatus and/or may not have the ability to lift and move heavy apparatuses. Further, prior putting apparatuses are not able to be stored in a flat and stacked configuration. It would be desirable to provide an improved putting apparatus that can easily be assembled by all golfers, including young and elderly golfers. It would also be desirable to provide an improved putting apparatus that can easily be stored, for example in a flat and stacked configuration. Prior putting apparatuses often have a large size that makes it difficult to store or placed out of view. It would therefore also be desirable to provide an improved putting apparatus that has a size and shape that can easily be stored in smaller spaces. Further, it would be desirable to provide an improve putting apparatus that is lightweight and easy to carry.

SUMMARY

Figure 1:
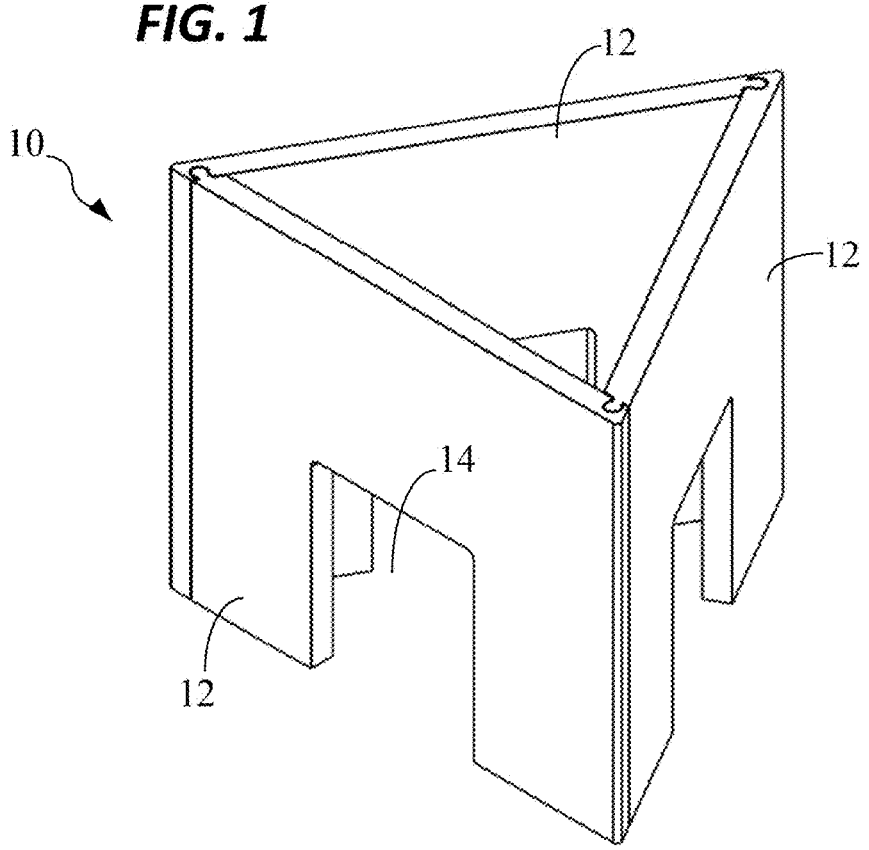
FIG. 1 is a perspective view of a golf putting apparatus according to a first embodiment.
Figure 2:
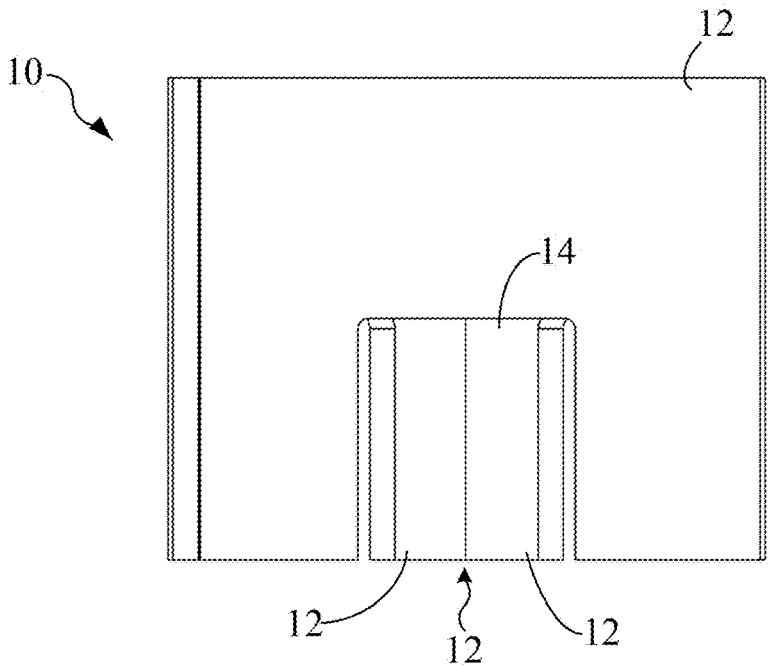
FIG. 2 is a side view of the golf putting practice apparatus of FIG. 1.
Figure 3:
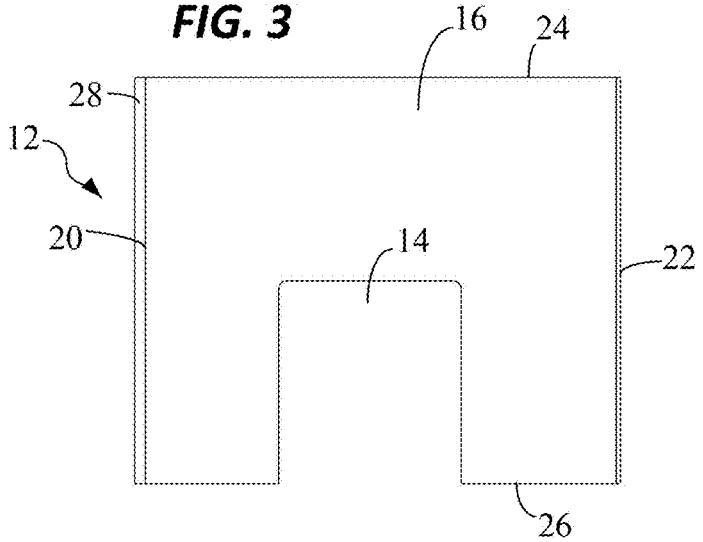
FIG. 3 is a front view of an interlockable panel of the first apparatus according to an embodiment.
Figure 4:
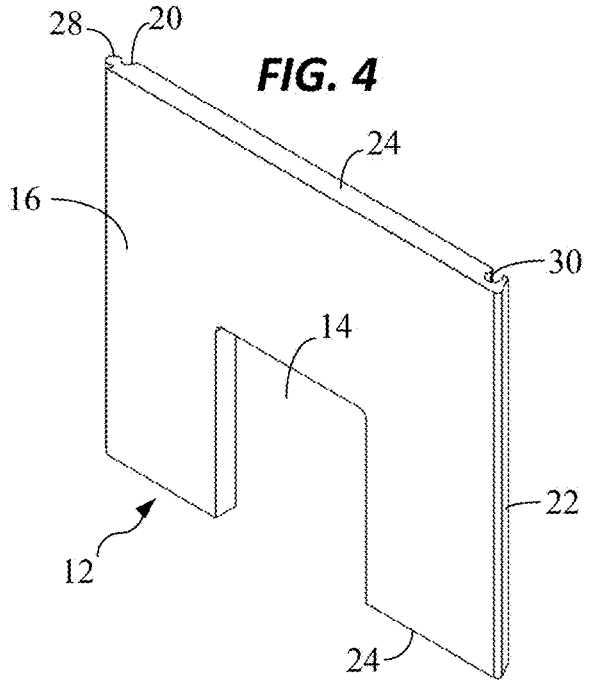
FIG. 4 is a perspective view of the interlockable panel of FIG. 3.
Figure 5:
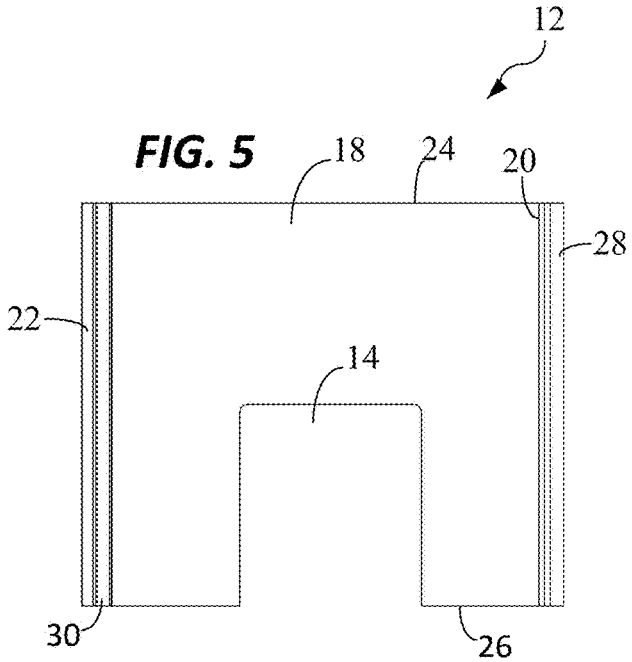
FIG. 5 is a rear view of the interlockable panel of FIG. 3.
Figure 6:
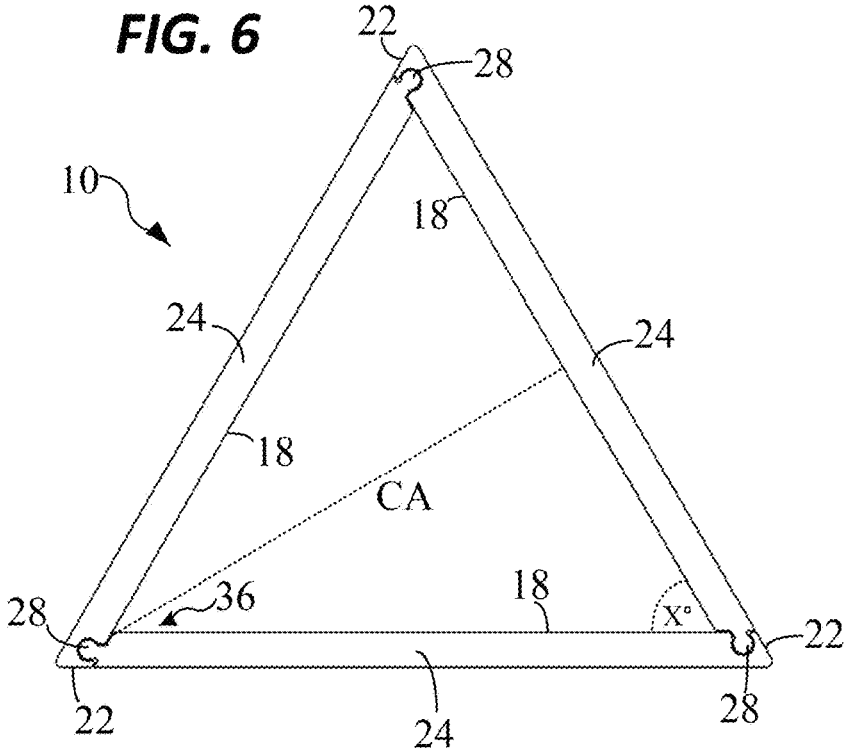
FIG. 6 is a top view of the golf putting practice apparatus of FIG. 1.
Figure 7:
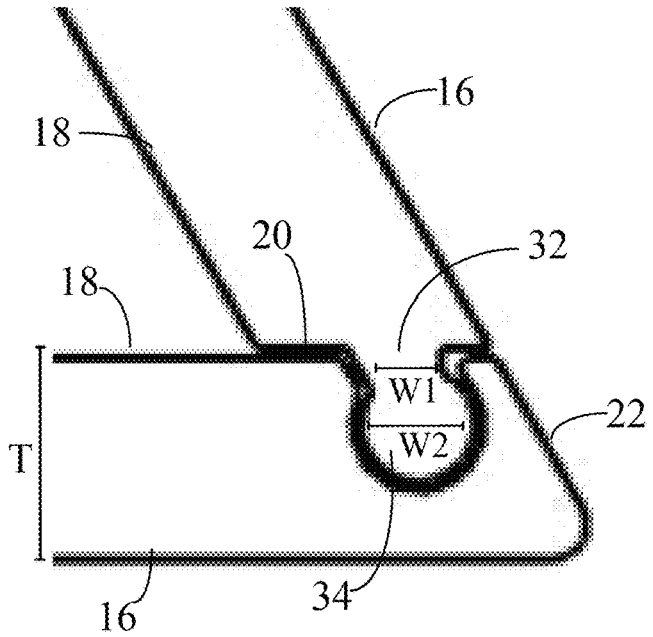
FIG. 7 is a cutout view of FIG. 5
Figure 8:
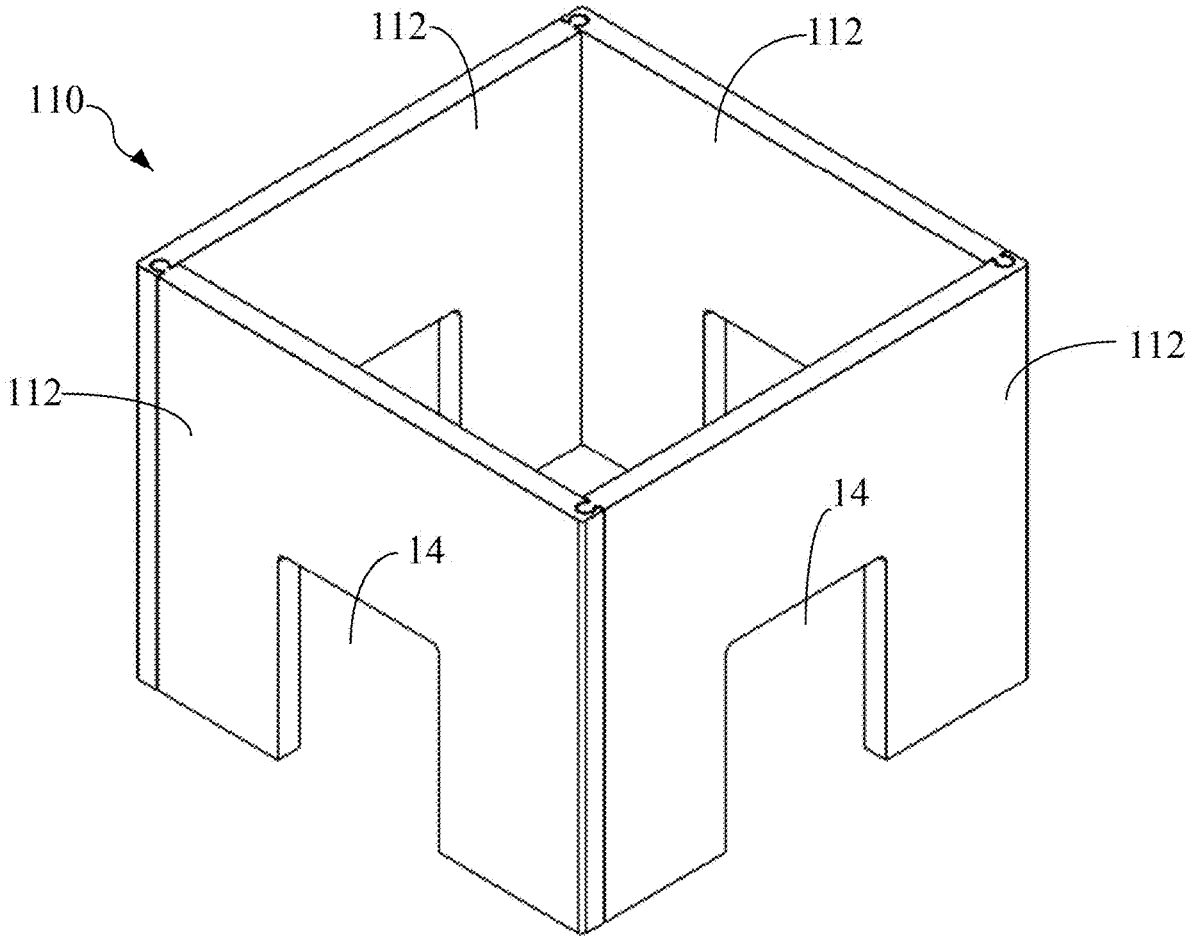
FIG. 8 is a perspective view of a golf putting apparatus according to a second embodiment.
Figure 9:
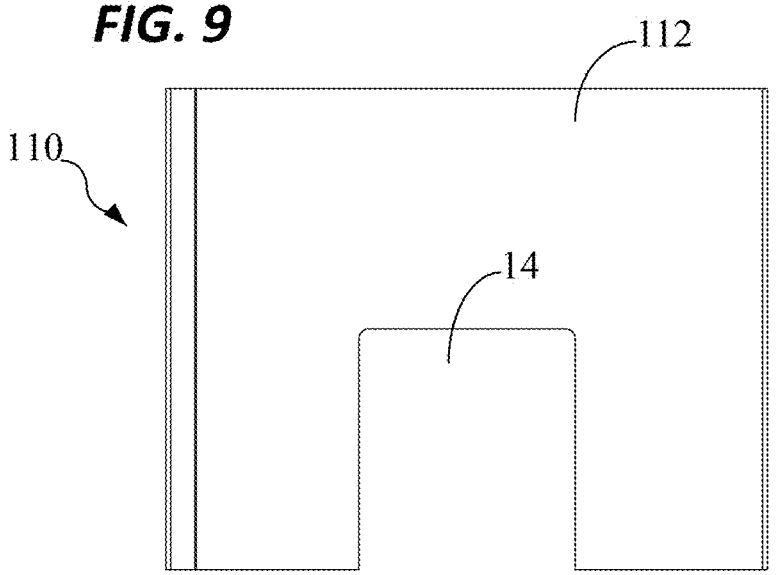
FIG. 9 is a side view of the golf putting apparatus of FIG. 8.
Figure 10:
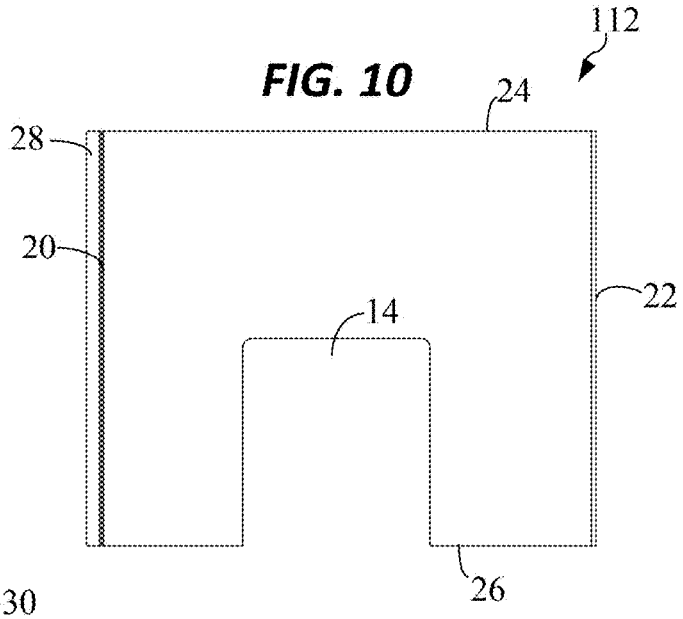
FIG. 10 is a front view of an interlockable panel of the second apparatus according to an embodiment.
Figure 11:
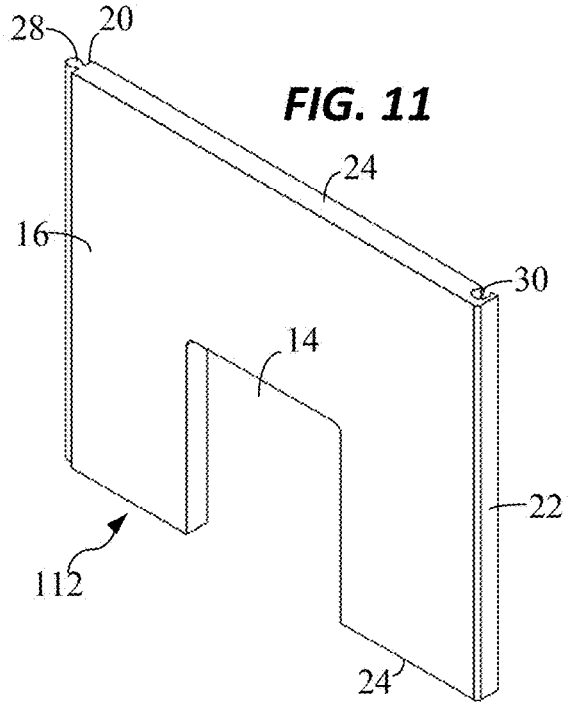
FIG. 11 is a perspective view of the interlockable panel of FIG. 10.
Figure 12:
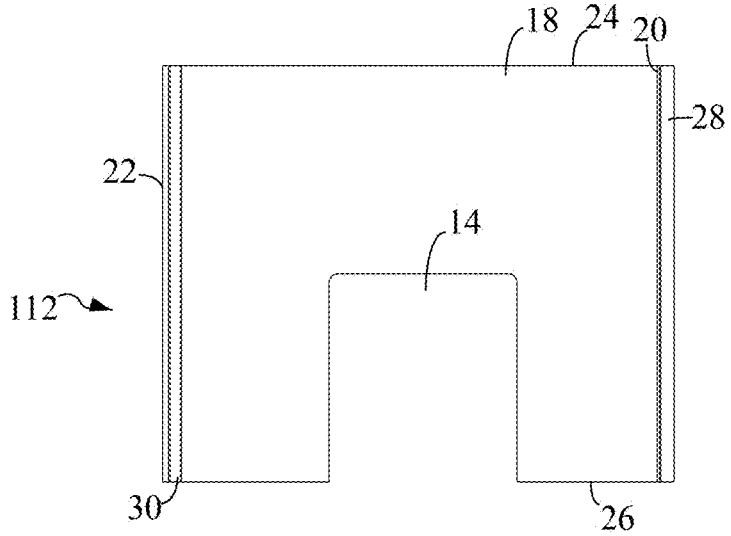
FIG. 12 is a rear view of the interlockable panel of FIG. 10.
Figure 13:
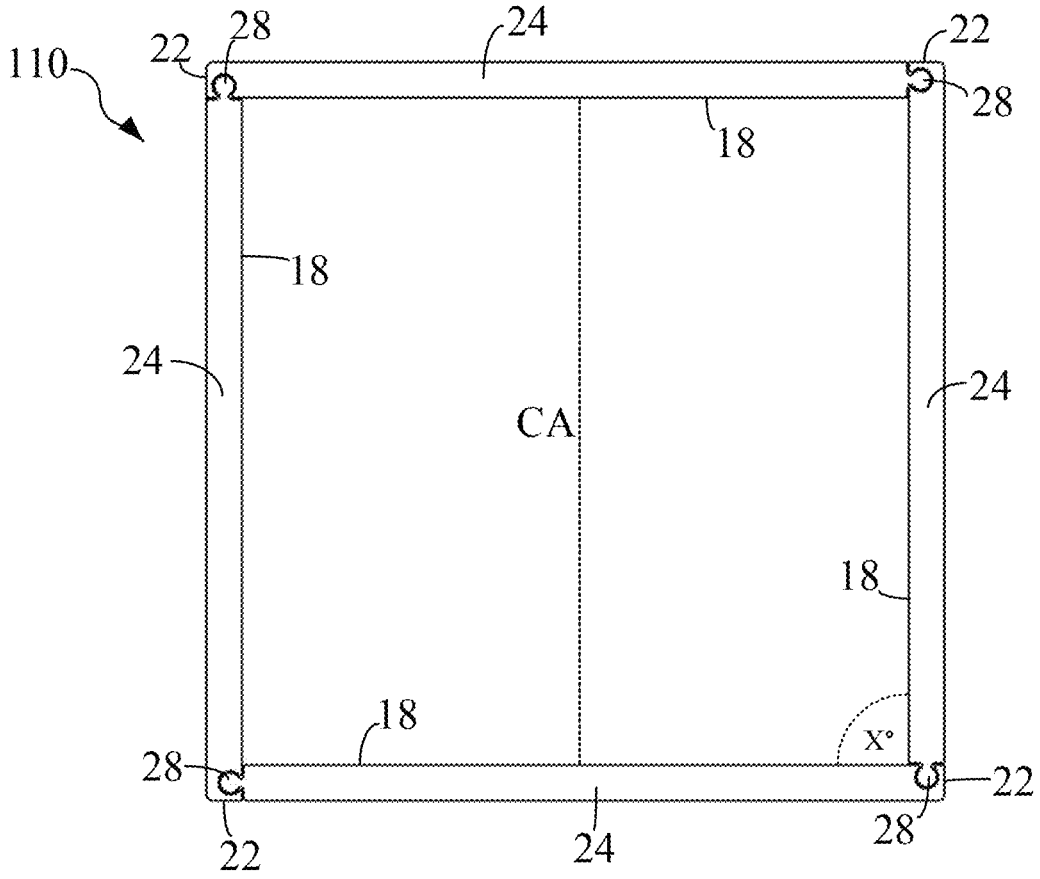
FIG. 13 is a top view of the golf putting apparatus of FIG. 9.
Figure 14:
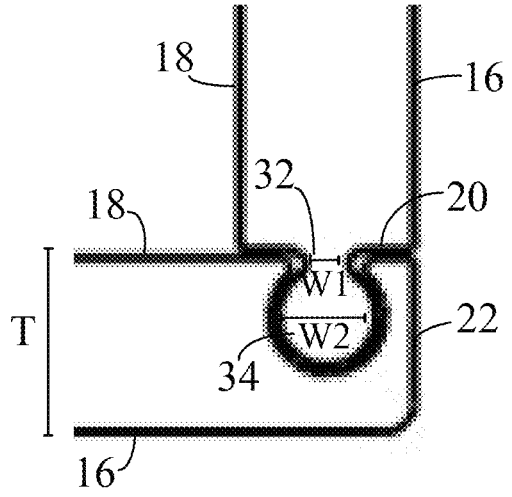
FIG. 14 is a cutout view of FIG. 13.

Certain embodiments include a golf putting apparatus. In some embodiments, the golf putting apparatus includes three interlockable panels configured to interlock to form a triangular enclosure. The triangular enclosure has three openings opposite to three corners. The triangular enclosure can be an equilateral triangular enclosure in some cases. In other embodiments, the golf putting apparatus includes four interlockable panels configured to interlock to form a square enclosure. The square enclosure has four openings, with each opening being opposite to another opening. The interlockable panels are easily assembled together and easily separated to be stored in a flat and stacked configuration.

Each interlockable panel includes a first face and an opposite second face, a top edge and an opposite bottom edge, and a first side edge and an opposite second side edge. Each panel also includes an opening extending between the first face and the second face, the opening being equidistant between the first side edge and the second side edge.

Further, each interlockable panel includes include a first end connector proximate the first side edge and a second end connector proximate the second side edge. The first end connector is configured to interlock with the second end connector on an adjacent panel. For example, in some cases, a first end connector can be reversibly and slidably received by a second end connector on an adjacent panel.

In some embodiments, the first end connector is provided along the first side edge and the second end connector is provided along the second face. In some cases, the first end connector extends along the entire first side edge from the top edge to the bottom edge, and the second end connector extends along the entire second face from the top edge to the bottom edge.

In certain cases, the first end connector has a male-shaped cross-section that extends along the first side edge and the second end connector has a female-shaped cross-section that extends along the second face. In some cases, the male-shaped cross-section includes a neck and a head portion that extends outward from the neck. The neck can be positioned between the first face and the second face so that it is closer to the first face than the second face, or the neck can be positioned to be equidistant between the first face and the second face.

The interlockable panels can also be assembled so that so that each first side edge is flush with each second face and each second side edge is flush with each first face.

DETAILED DESCRIPTION

The present disclosure relates to a golf putting apparatus that can easily be assembled while easily being stacked for storage. The golf putting apparatus includes a plurality of interlockable panels wherein each interlockable panel interlocks with another interlockable panel. In an interlocked configuration, the apparatus stands on a surface for use. In the separated and unlocked configuration, the apparatus can be stacked for storage.

FIGS. 1-7 and 15 illustrate a golf putting apparatus 10 having three interlockable panels 12 according to a first embodiment. The three interlockable panels 12 can be interlocked to form a triangular enclosure. In many cases, the triangular enclosure is an equilateral triangular enclosure having corners with 60° angles. Each interlockable panel 12 includes an opening 14 through which a golf ball can pass through. Also, each opening 14 is opposite to each corner.

Each interlockable panel 12 comprises a rigid material that includes a first face 16 and a second face 18 opposite the first face 16. In some embodiments, the first face 16 and the second face 18 are planar faces. In many cases, the planar faces are flat faces.

Each interlockable panel 12 also includes a first side edge 20, a second side edge 22 opposite the first side edge, a top edge 24 and a bottom edge 26 opposite the top edge. Further, the bottom edge 22 is configured to engage with a ground surface such as a floor. In many cases, the bottom edge 22 is a straight edge that engages with the ground surface to provide the interlockable panel in a level configuration. The top edge 22 can also be a straight edge if desired. In some cases, the top edge 24 and the bottom edge 26 are straight edges that are parallel to each other.

In the first embodiment, the first side edge 20 can be an angled edge. Likewise, the second side edge 22 can be an angled edge. The angled edges allow adjacent interlockable panels 12 to be mated together to form a triangular configuration. Once mated, the first side edge 20 is flush with the second face 18 and the second side edge 22 is flush with the first face 16.

Each interlockable panel 12 also has thickness T between the first face 16 and the second face 18. The thickness T can be any thickness that allows the interlockable panel 12 to stand in an upright configuration once assembled with an adjacent interlockable panel. In some cases, the thickness T is 1 centimeter or less. In certain cases, the thickness T is between 0.5 centimeter and 1.0 centimeter, such as 0.75 centimeter. Of course, other thicknesses can also be used.

The opening 14 of each interlockable panel 12 extends between the first face 16 and the second face 18. The opening 14 can be a cut-out portion of the interlockable panel 12 that is provided along the bottom edge 26. The opening 14 is sized and shaped to accommodate the passing therethrough of a standard sized golf ball, which is typically 1.680 inches or more and 2 inches or less. In some embodiments, the opening 14 has a square shape having one side of the square in line with the bottom edge 26. In other embodiments, the opening 14 has a rectangular shape. The opening 14 can also be equidistant between the first side edge 20 and the second side edge 22. In some cases, the opening 14 has a height of 3 inches or less. Also, in some cases, the opening has a width of between 2 inches and 3 inches, such as 2.5 inches. In further cases, the opening 14 has a width of 3 inches or less. In certain cases, the width is between 2 inches and 3 inches, such as 2.25 inches. Skilled artisans will understand that other shapes and dimensions can instead be used.

The interlockable panel 12 also includes a first end connector 28 proximate the first side edge 20 and a second end connector 30 proximate the second side edge 22. In some embodiments, the end connectors 28, 30 are integral to the interlockable panel 12. For example, the entire interlockable panel 12 can be formed of a single material. Specifically, the entire interlockable panel 12 can be formed from a single piece of plastic or a single piece of wood.

The first end connector 28 is configured to reversibly attach to a second end connector 30 on an adjacent interlockable panel 12. In such cases, the first end connector 28 has a different configuration than the second end connector 30. For example, the first end connector 28 can have a male component and the second end connector 30 can have a female component. This allows the first end connector 28 and the second end connector 30 to mate.

In many cases, the first end connector 28 is provided along the first side edge 20 and the second end connector 30 is provided along a second face 18 proximate the second side edge 22. In certain embodiments, the first end connector 28 extends along the entire first side edge 20 from the top edge 24 to the bottom edge 26. The first end connector 28 has a male-shaped cross-section along the side edge. In the illustrated embodiment, the first end connector 28 has a plug-shaped cross section that extends along the entire first side edge 20.

Similarly, in many cases, the second end connector 30 extends along the entire second surface 16 from the top edge 24 to the bottom edge 26 at a location proximate the second side edge 22. The second end connector 30 has a female-shaped cross-section. In the illustrated embodiment, the second end connector 30 has a socket-shaped cross section.

The first end connector 28 can also be slidably received by the second end connector 30 to connect adjacent interlockable panels. Likewise, the first end connector 28 can be slidably removed from the second end connector 30 to disconnect adjacent interlockable panels. For example, the plug-shaped cross section of the first end connector 28 can be slidably received by the socket-shaped cross-section of the second end connector 30.

The plug shaped cross-section of the first end connector 28 can have a neck 32 and a head portion 34 that extends outward the neck 32. The neck 28 is positioned between the first side edge 20 and the head portion 34. The neck 28 is also positioned such that it is between the first face 16 and the second face 18. In the first embodiment, the neck 28 is positioned to be closer to the first face 16 than the second face 18. The neck 32 has a width W1, which is the greatest width of any portion of the neck 32. The head portion 34 also has a width W2, which is the greatest width of any portion of the head portion 34. This configuration allows the head portion 34 to be secured within a corresponding socket-shaped cross-section 30 of an adjacent interlockable panel 12.

Three interlockable panels 12 are assembled to form an interlocked triangular-shaped enclosure. In some cases, the three interlockable panels are identical. Each interlockable panel 12 can be approximately 60° from an adjacent interlockable panel 12. The interlocked panels 12 also form a corner 36 wherein no opening is present. Each opening 14 is opposite to a corner 36. A center axis CA extending through the center of an opening 14 can intersect at a corner 36. This configuration helps keep a golf ball inside the enclosure after it moves through an opening 14. A triangular-shaped enclosure allows a golfer to putt a ball into the triangle through three different openings while also keeping the ball inside the enclosure and allowing for easier collection.

When interlocked, each panel 12 stands on a surface. Each panel 12 can also have a desired height and width. In some cases, each panel 12 has a height of 6 inches or less. In certain cases, the height is between 4 inches and 6 inches, such as 5 inches. Also, in some cases, each panel has a width of 7 inches or less. In certain cases, the width is between 5 inches and 7 inches, such as 6 inches. Such dimensions are advantageous in cases where it is desirable to provide a small apparatus that can be stored in small spaces and transported easily.

Also, each panel 12 of this first embodiment can have a weight of 1 pound or less. In some cases, each panel has a weight of 0.5 pound or less, such as 0.2 pound or less or perhaps 0.12 pound or less. Further, the three interlocked panels can have a total weight of 3 pounds or less, such as 1.5 pounds or less. In certain cases, the panels have a total weight of 1.0 pound or less, such as 0.75 pound or less and perhaps 0.5 pound or less, such as between 0.3 to 0.4 pound. Such a light weight allows for the apparatus to be easily picked up and carried, particularly by weak or elderly golfers.

FIGS. 8-14 and 16 illustrate a golf putting apparatus 110 having four interlockable panels 112 according to a second embodiment. The four interlockable panels 112 can be interlocked to form a square-shaped enclosure that stands on a surface. Here too, each interlockable panel 112 includes an opening 14 through which a golf ball can pass through. The four interlockable panels 112 can also bet separated and stacked for storage.

Each interlockable panel 112 can have any of the features already described herein for interlockable panel 12 with a few differences. In the second embodiment, the first side edge 20 and the second side edge 22 are straight side edges that are perpendicular to the first face 16 and second face 18. The straight edges 20, 22 allow adjacent interlockable panels 12 to be mated together to form a square configuration. Once mated, the first side edge 20 is flush with the second face 18 and the second side edge 22 is flush with the first face 16. Also, in the second embodiment, the neck 28 is positioned to be equidistant between the first face 16 than the second face 18.

The interlockable panels 112 in the second embodiment are assembled to form an interlocked square-shaped enclosure. Each interlockable panel 112 can be approximately 90° from an adjacent interlockable panel 12. Each opening 14 is opposite to another opening 14. A center axis CA extending through the center of an opening 14 can intersect a center of another opening 14 on an opposite interlockable panel 112. This configuration allows a more experienced golfer to practice putting in a straight line through two openings 14, which is more difficult than putting through a single opening.

Each panel 112 can also have a desired height and width. In some cases, each panel 12 has a height of 6 inches or less. In certain cases, the height is between 4 inches and 6 inches, such as 5 inches. Also, in some cases, each panel has a width of 7 inches or less. In certain cases, the width is between 5 inches and 7 inches, such as 6 inches. Additionally, each panel 112 of the second embodiment can have a weight of 1 pound or less. In some cases, each panel has a weight of 0.5 pound or less, such as 0.2 pound or less or perhaps 0.12 pound or less. Further, the four interlocked panels can have a total weight of 3 pounds or less, such as 1.5 pounds or less. In certain cases, the panels have a total weight of 1.0 pound or less, such as 0.75 pound or less and perhaps 0.5 pound or less, such as between 0.4 to 0.5 pound. Again, these small dimensions and lighter weight allows for the apparatus to be handled by all types of golfers, including the elderly.

Figure 15:
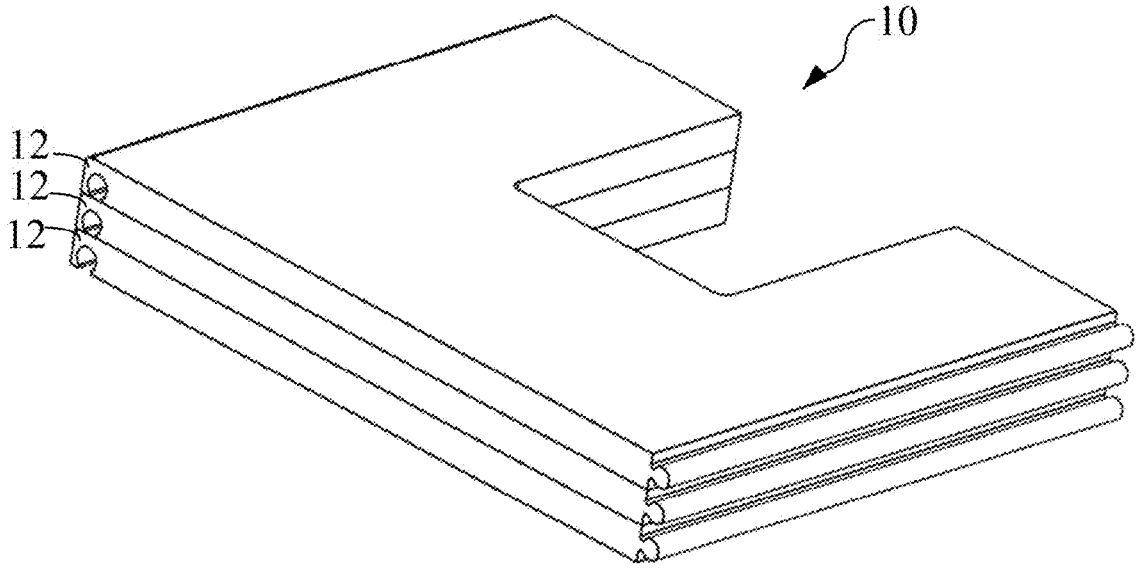
FIG. 15 is a perspective view of a disassembled golf putting apparatus according to the first embodiment.
Figure 16:
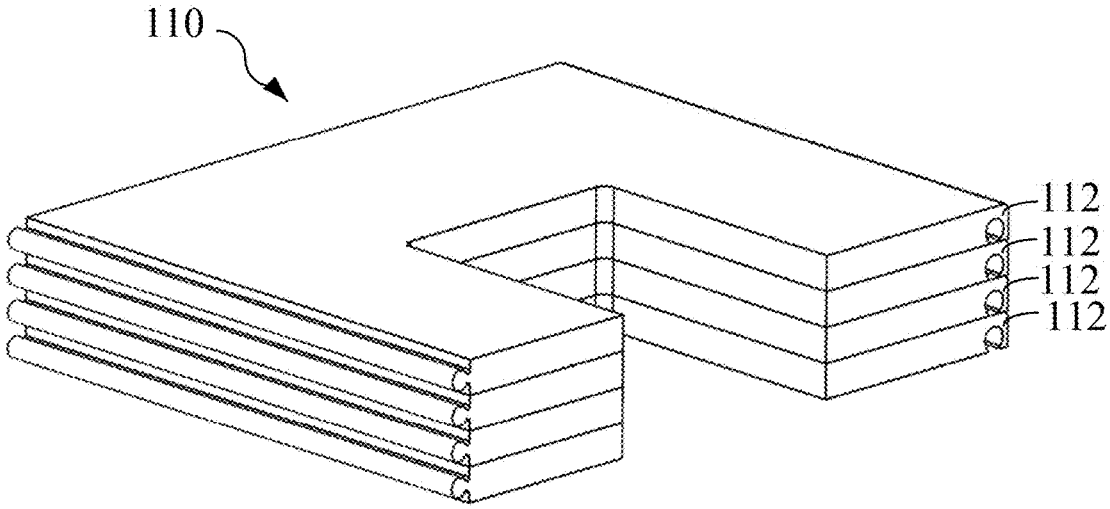
FIG. 16 is a perspective view of a disassembled golf putting apparatus according to the second embodiment.

The apparatus can include a variety of features to facilitate transport and storage of the apparatus. FIG. 15 shows the apparatus 10 of the first embodiment in a disassembled position. Similarly, FIG. 16 shows the apparatus 110 of the second embodiment in a disassembled position. In the disassembled position, the interlockable panels 12, 112 are stacked together. In particular, the panels 12, 112 are stacked together such that the second face 18, 118 contacts and rests against a first face 16, 116 of an underlying panel 12, 112. In particular cases, the second face 18, 118 of an overlying panel 12, 112 contacts substantially an entire first face 16, 116 of an underlying panel 12, 112. Such stacking facilitates storage of the apparatus in smaller spaces.

While the various systems described above are separate implementations, any of the individual components, mechanisms, or devices, and related features and functionality, within the various system embodiments described in detail above can be incorporated into any of the other system embodiments herein. Further, although the various embodiments have been described with reference to preferred implementations, persons skilled in the art will recognize that changes may be made in form and detail without departing from the spirit and scope thereof.

The invention claimed is:

1. A golf putting practice apparatus, comprising:

three interlockable panels, wherein each interlockable panel includes:

a first face and an opposite second face;

a top edge and an opposite bottom edge;

a first side edge and an opposite second side edge;

an opening extending between the first face and the second face, wherein the opening is equidistant between the first side edge and the second side edge; and a first end connector proximate the first side edge and a second end connector proximate the second side edge, the first end connector being configured to interlock with a second end connector on an adjacent panel, wherein the three interlockable panels are configured to interlock to form a triangular enclosure having three openings opposite to three corners, wherein the first end connector is provided along the first side edge and the second end connector is provided along the second face, wherein the first end connector has a male-shaped cross-section that extends along the first side edge and the second end connector has a female-shaped cross-section that extends along the second face, the male-shaped cross-section including a neck and a head portion that extends outward from the neck, wherein the neck is positioned between the first face and the second face so that it is closer to the first face than the second face, and wherein the three interlockable panels are assembled so that each first side edge is flush with each second face and each second side edge is flush with each first face.

2. The golf putting practice apparatus of claim 1, wherein the triangular enclosure is an equilateral triangular enclosure.

3. The golf putting practice apparatus of claim 1, wherein each first end connector is reversibly and slidably received by each second end connector.

4. The golf putting practice apparatus of claim 1, wherein the first end connector extends along the entire first side edge from the top edge to the bottom edge, and the second end connector extends along the entire second face from the top edge to the bottom edge.

5. The golf putting practice apparatus of claim 1, wherein the three interlockable panels have a height of 6 inches or less and a width of 7 inches or less.

6. The golf putting practice apparatus of claim 1, wherein the three interlockable panels are configured to be stackable such that the second face of an overlying interlockable panel contacts a first face of an underlying interlockable panel.

7. The golf putting practice apparatus of claim 6, wherein each interlockable panel has a weight of 1 pound or less.

8. The golf putting practice apparatus of claim 7, wherein each interlockable panel has a weight of 0.5 pound or less.

9. The golf putting practice apparatus of claim 7, wherein the three interlockable panels have a total weight of 3 pounds or less.

10. The golf putting practice apparatus of claim 8, wherein the three interlockable panels have a total weight of 1.5 pounds or less.

11. A golf putting practice apparatus, comprising:

four interlockable panels, wherein each interlockable panel includes:

a first face and an opposite second face;

a top edge and an opposite bottom edge;

a first side edge and an opposite second side edge;

an opening extending between the first face and the second face, wherein the opening is equidistant between the first side edge and the second side edge; and a first end connector proximate the first side edge and a second end connector proximate the second side edge, the first end connector being configured to interlock with a second end connector on an adjacent panel, wherein the four interlockable panels are configured to interlock to form a square enclosure having four openings, wherein each opening of the four openings is opposite to another opening, wherein the first end connector is provided along the first side edge and the second end connector is provided along the second face, wherein the first end connector has a male-shaped cross-section that extends along the first side edge and the second end connector has a female-shaped cross-section that extends along the second face, the male-shaped cross-section including a neck and a head portion that extends outward from the neck, and wherein the four interlockable panels are assembled so that each first side edge is flush with each second face and each second side edge is flush with each first face.

12. The golf putting practice apparatus of claim 11, wherein each first end connector is reversibly and slidably received by each second end connector.

13. The golf putting practice apparatus of claim 11, wherein the first end connector extends along the entire first side edge from the top edge to the bottom edge, and the second end connector extends along the entire second face from the top edge to the bottom edge.

14. The golf putting practice apparatus of claim 13, wherein the neck is positioned to be equidistant between the first face and the second face.

15. The golf putting practice apparatus of claim 11, wherein the four interlockable panels are configured to be stackable such that the second face of an overlying interlockable panel contacts a first face of an underlying interlockable panel.

16. The golf putting practice apparatus of claim 15, wherein each interlockable panel has a weight of 1 pound or less.

17. The golf putting practice apparatus of claim 16, wherein the four interlockable panels have a total weight of 3 pounds or less.

18. The golf putting practice apparatus of claim 16, wherein each interlockable panel has a weight of 0.5 pound or less.

19. The golf putting practice apparatus of claim 18, wherein the four interlockable panels have a total weight of 1.5 pounds or less.

* * * * *